US005870828A

United States Patent [19]

Polites

[11] Patent Number: 5,870,828

[45] Date of Patent: Feb. 16, 1999

[54] UTILITY KNIFE SYSTEM

[75] Inventor: Alexandra Polites, New York, N.Y.

[73] Assignee: Violex-Bic, S.A., Attica, Greece

[21] Appl. No.: 869,571

[22] Filed: Jun. 5, 1997

Related U.S. Application Data

[63] Continuation of Ser. No. 868,438, Jun. 4, 1997, abandoned.

[51] Int. Cl.[6] ..... B26B 1/08

[52] U.S. Cl. ..... 30/162; 30/151; 30/337; 30/339

[58] Field of Search ..... 30/2, 151, 162, 30/329, 335, 337, 339

[56] References Cited

U.S. PATENT DOCUMENTS

| | | | |
|---|---|---|---|
| 2,605,545 | 8/1952 | Weems | 30/337 |
| 2,874,462 | 2/1959 | Benedict, Jr. et al. | 30/162 |
| 3,025,598 | 3/1962 | Nissen . | |
| 3,577,637 | 5/1971 | Braginetz | 30/162 |
| 3,765,089 | 10/1973 | Ibata | 30/320 |
| 3,899,828 | 8/1975 | Bosco | 30/151 |
| 3,927,473 | 12/1975 | Braginetz | 30/125 |
| 4,292,738 | 10/1981 | Osada | 30/162 |
| 4,509,260 | 4/1985 | Gringer | 30/162 |
| 4,531,286 | 7/1985 | Vito et al. | 30/2 |
| 4,835,865 | 6/1989 | Knoop | 30/162 |
| 4,920,646 | 5/1990 | Grant | 30/162 |
| 5,241,750 | 9/1993 | Chomiak | 30/2 |
| 5,330,493 | 7/1994 | Haining | 30/151 |
| 5,330,494 | 7/1994 | Van Der Westhuizen et al. | 30/151 |
| 5,363,958 | 11/1994 | Horan | 30/339 |
| 5,433,321 | 7/1995 | Abidin et al. | 30/339 |
| 5,478,346 | 12/1995 | Capewell | 30/151 |
| 5,613,300 | 3/1997 | Schmidt | 30/2 |

*Primary Examiner*—Hwei-Siu Payer
*Attorney, Agent, or Firm*—Baker & Botts, L.L.P.

[57] ABSTRACT

A utility knife system comprises a handle assembly, a blade assembly, and a protective blade cover. The handle assembly and the blade assembly have complementary latching mechanisms for easy exchange of blades without opening the handle. The protective blade cover functions cooperatively with the handle assembly and blade assembly to ensure that a user does not touch the cutting edges of blades while exchanging them.

9 Claims, 14 Drawing Sheets

UTILITY KNIFE SYSTEM

CROSS-REFERENCE TO RELATED APPLICATIONS

This application is a continuation of U.S. patent application Ser. No. 08/868,438, filed on Jun. 4, 1997, now abandoned.

BACKGROUND OF INVENTION

This invention relates to a utility knife system, which comprises a knife handle, exchangeable blades, and protective covers for the blades.

Utility knives are versatile cutting tools that feature a blade slidable in and out of a knife handle. Typically, to replace the blade of a utility knife when the blade becomes dull, a user must unscrew and open the utility knife handle to gain access to the blade.

To make the replacement of blades more convenient, various configurations for utility knives for which the blades may be replaced without opening the knife handle are known. For example, in U.S. Pat. No. 3,577,637, filed by Braginetz on Sep. 24, 1968 and issued on May 4, 1971, a utility knife is disclosed containing a blade carrier with a resilient portion that can be moved laterally by a tab. The resilient portion contains a lug that engages certain notches on the blade.

As another example, U.S. Pat. No. 3,025,598, filed by Nissen on Oct. 13, 1958 and issued on Mar. 30, 1962, discloses a utility knife having a blade with a rounded, knob-like end. The utility knife handle contains a blade carrier having a resilient upper portion. The upper portion of the blade carrier contains a shoulder. When the blade is inserted into the handle, the rounded end of the blade exerts a downward force on the shoulder, causing the upper portion to depress. When the rounded end passes the shoulder, the upper portion springs back to its normal position, causing the shoulder to engage the rear of the rounded end. To disengage the blade, the upper portion is depressed using a tab coupled to the upper portion.

In each of the above-described known configurations for replacing blades within a utility knife handle, a risk exists that a user may cut himself or herself while replacing a blade because the cutting edge of the blade is left exposed. To date, therefore, each configuration for replacing blades within a utility knife involves a safety risk to the user.

SUMMARY OF THE INVENTION

The present invention is directed to a utility knife system that is simple and inexpensive to manufacture and provides a convenient and safe configuration for quickly exchanging blades without opening the handle. According to the present invention, a utility knife system comprises a handle assembly, a blade assembly, and a protective blade cover.

The handle assembly comprises an elongated housing, a guide, and a tab. The elongated housing has an internal chamber, a blade opening at an end of the housing for receiving a blade, and a slot disposed parallel to the longitudinal axis of the housing for access to the internal chamber. The guide is located within the housing and is slidable along the longitudinal axis of the housing. The guide comprises a first latching mechanism disposed on the side facing the blade opening. The tab is attached to the guide and extends out of the slot in the housing. The tab is used for controlling the movement of the guide.

The blade assembly comprises a blade and an endpiece. The blade has a cutting edge and two ends disposed on opposite sides of the cutting edge. The endpiece is attached to one of the two ends of the blade and has second and third latching mechanisms, the second latching mechanism being complementary to the first latching mechanism of the handle assembly guide.

The protective blade cover comprises an enclosed hollow structure with an opening for receiving the blade assembly. The hollow structure has inner dimensions such that the protective blade cover fits securely over the blade assembly and outer dimensions such that the protective blade cover completely covers the cutting edge of the blade assembly while leaving exposed the second latching mechanism of the endpiece. The protective blade cover also has a fourth latching mechanism complementary to the third latching mechanism of the endpiece.

To store a blade assembly, the protective blade cover is inserted over the blade assembly and the fourth latching mechanism of the protective blade cover is engaged with the third latching mechanism of the endpiece.

To load a blade assembly into the handle assembly, after the blade assembly has been stored in the protective blade cover, the endpiece of the blade assembly is inserted into the blade opening of the handle assembly housing, the second latching mechanism of the endpiece is engaged with the first latching mechanism of the handle assembly guide, and the fourth latching mechanism of the protective blade cover is disengaged from the third latching mechanism of the endpiece.

To unload a blade assembly from the handle assembly, the protective blade cover is inserted over the blade assembly, the fourth latching mechanism of the protective blade cover is engaged with the third latching mechanism of the endpiece, and the first latching mechanism of the handle assembly guide is disengaged from the second latching mechanism of the endpiece.

Preferably, the handle assembly further comprises a blade release button coupled to the guide for enabling the disengagement of the first latching mechanism of the guide from the second latching mechanism of the blade assembly endpiece.

Preferably, the slot in the handle assembly housing comprises a plurality of notches along its sides. Preferably, the tab comprises two resiliently yieldable prongs parallel to the longitudinal axis of the slot, each prong having a bulge portion that is engageable with at least one of the notches. Preferably, the handle assembly further comprises a lock arranged in a slidable relationship with the tab, the lock having a post that slides between the bulge portions of the tab prongs and prevents the bulge portions from yielding inwardly towards each other.

Preferably, the handle assembly guide comprises a first portion and a second portion, the first portion being resiliently yieldable with respect to the second portion. Preferably, the first latching mechanism comprises a hook on the first portion facing the blade opening of the handle assembly housing, and the second latching mechanism comprises a hook complementary to that of the first latching mechanism.

Preferably, the third latching mechanism of the blade assembly endpiece comprises an indentation in an outer surface of the endpiece and the fourth latching mechanism of the protective blade cover comprises a protrusion complementary to the indentation, the protrusion mounted on a resiliently yieldable member of the protective blade cover.

Preferably, the outer dimensions of the protective blade cover are larger than those of the blade opening in the handle assembly housing.

Preferably, the protective blade cover further comprises a first side wall and a second side wall parallel to each other, an elongated projection on an outer surface of the first side wall having a substantially constant cross-section throughout its length, and one or more projections on an outer surface of the second side wall defining a slot for slidably receiving an element having the same shape as the elongated projection on the first side wall.

These and other features, aspects, and advantages of the present invention will become better understood with regard to the following detailed description, appended claims, and accompanying drawings.

DETAILED DESCRIPTION

Figure 1:
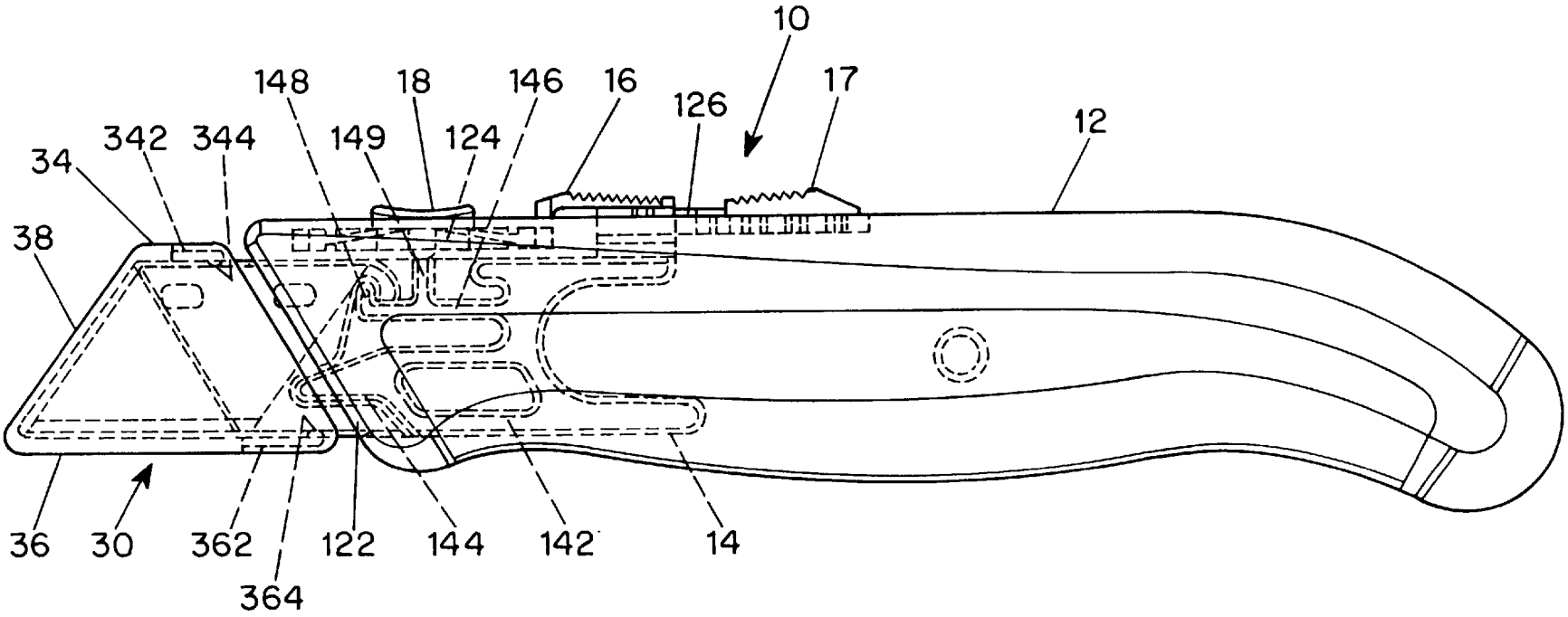
FIG. 1 is a side view of a utility knife system according to a preferred embodiment of the present invention.
Figure 2:
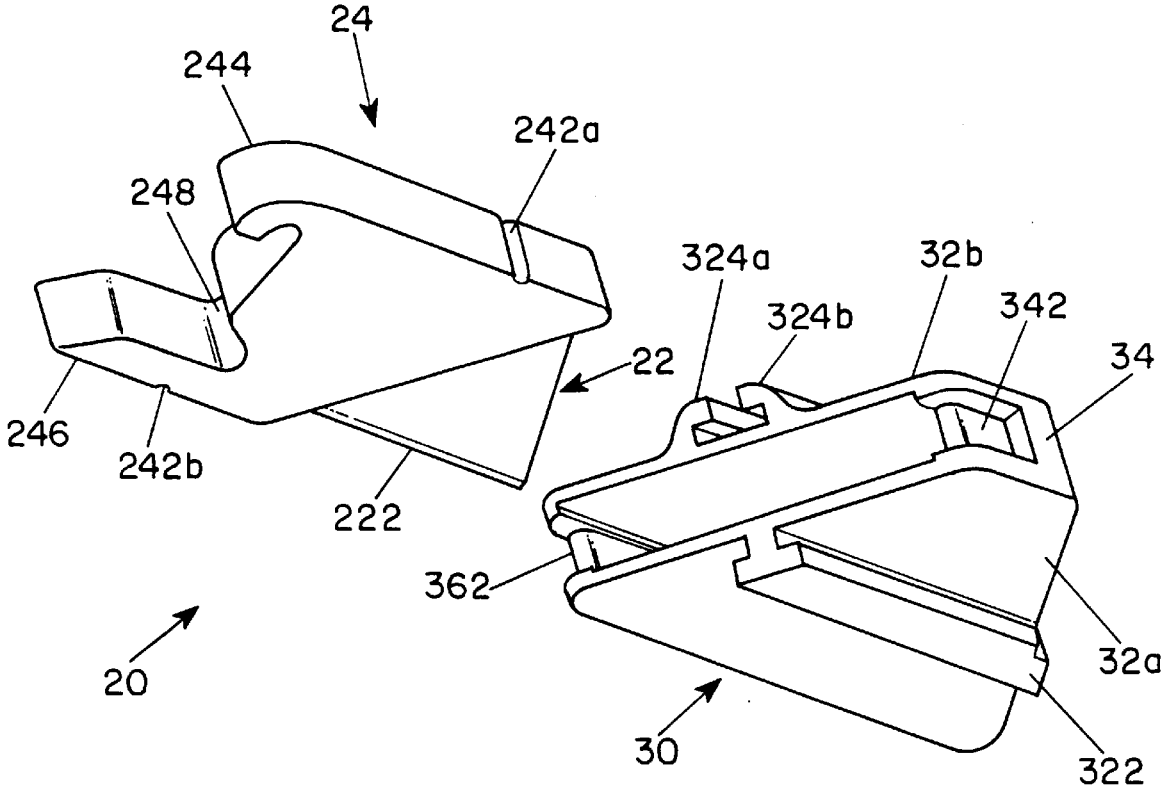
FIG. 2 is a three-dimensional perspective view of a blade assembly and a protective blade cover, both according to a preferred embodiment of the present invention, which are disengaged from each other.

As shown in the drawings, and in particular FIGS. 1 and 2, a utility knife system according to a preferred embodiment of the present invention comprises a handle assembly 10, a blade assembly 20, and a protective blade cover 30.

Figure 7:
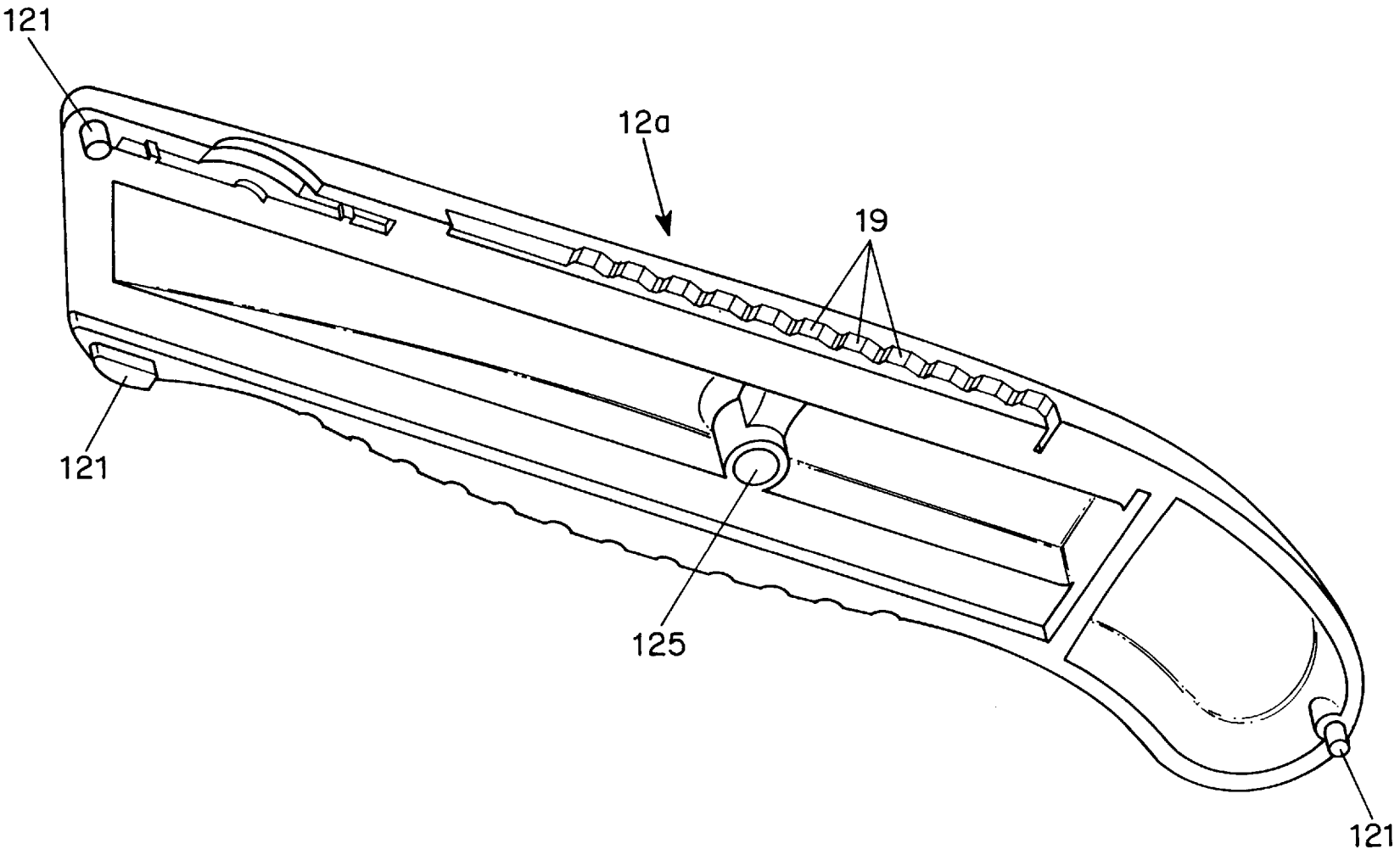
FIG. 7 is a three-dimensional perspective view of a housing half of a utility knife system according to a preferred embodiment of the present invention.
Figure 8:
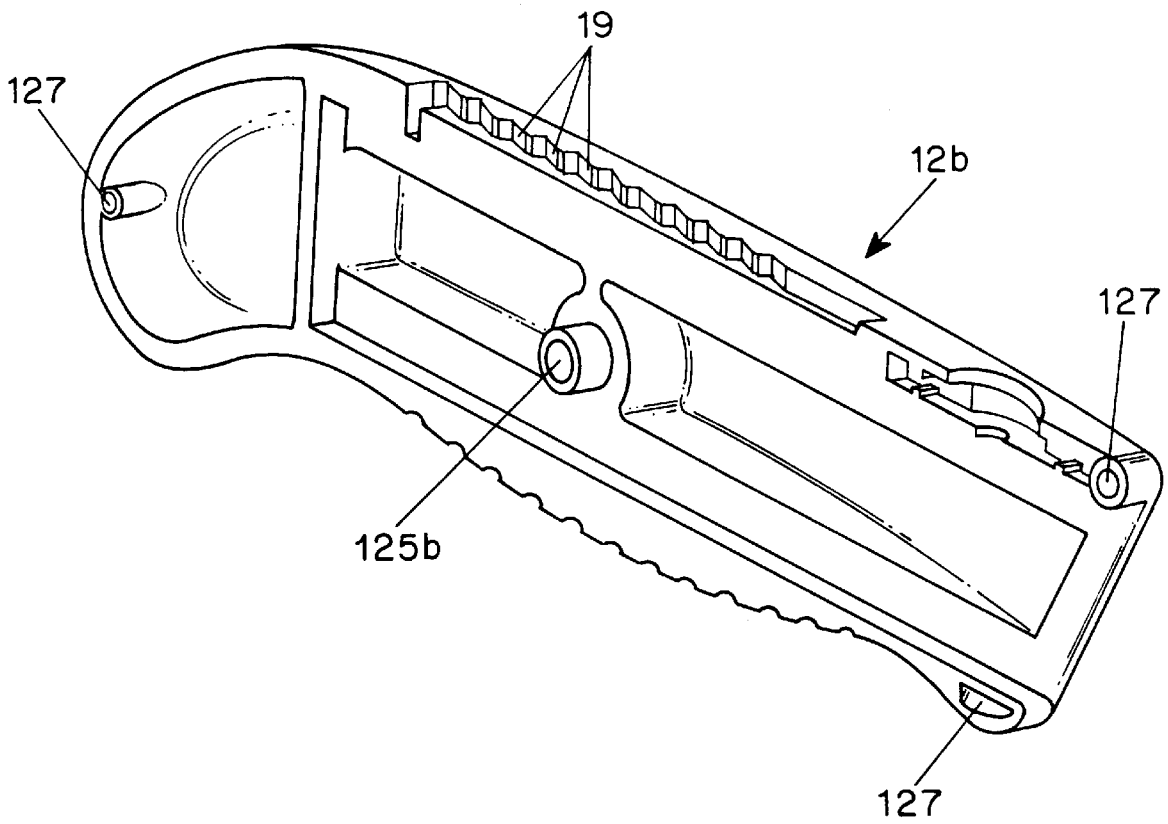
FIG. 8 is a three-dimensional perspective view of another housing half of a utility knife system according to a preferred embodiment of the present invention.

The handle assembly 10 comprises an elongated housing 12, a guide 14, a tab 16, a lock 17, and a blade release button 18. The elongated housing 12 is a hollow structure composed of two substantially identical halves 12*a* and 12*b* (as shown in FIGS. 7 and 8). Preferably, the housing halves 12*a* and 12*b* are joined together by a screw, and the halves include bores 125*a* and 125*b* through their centers through which the screw is passed. The bores may be unthreaded and a nut may be used in combination with the screw to hold the two halves together, or the bores may be threaded to hold the two halves together without the need for a nut. To assist in aligning the two halves, housing half 12*a* has flanges 121 and housing half 12*b* has flange receptacles 127. As an alternative to a screw, any suitable means of attaching the two halves together may be used. Preferably, the housing halves 12*a* and 12*b* are made by the die casting of a metallic material, such as ZAMAK.

Figure 6:
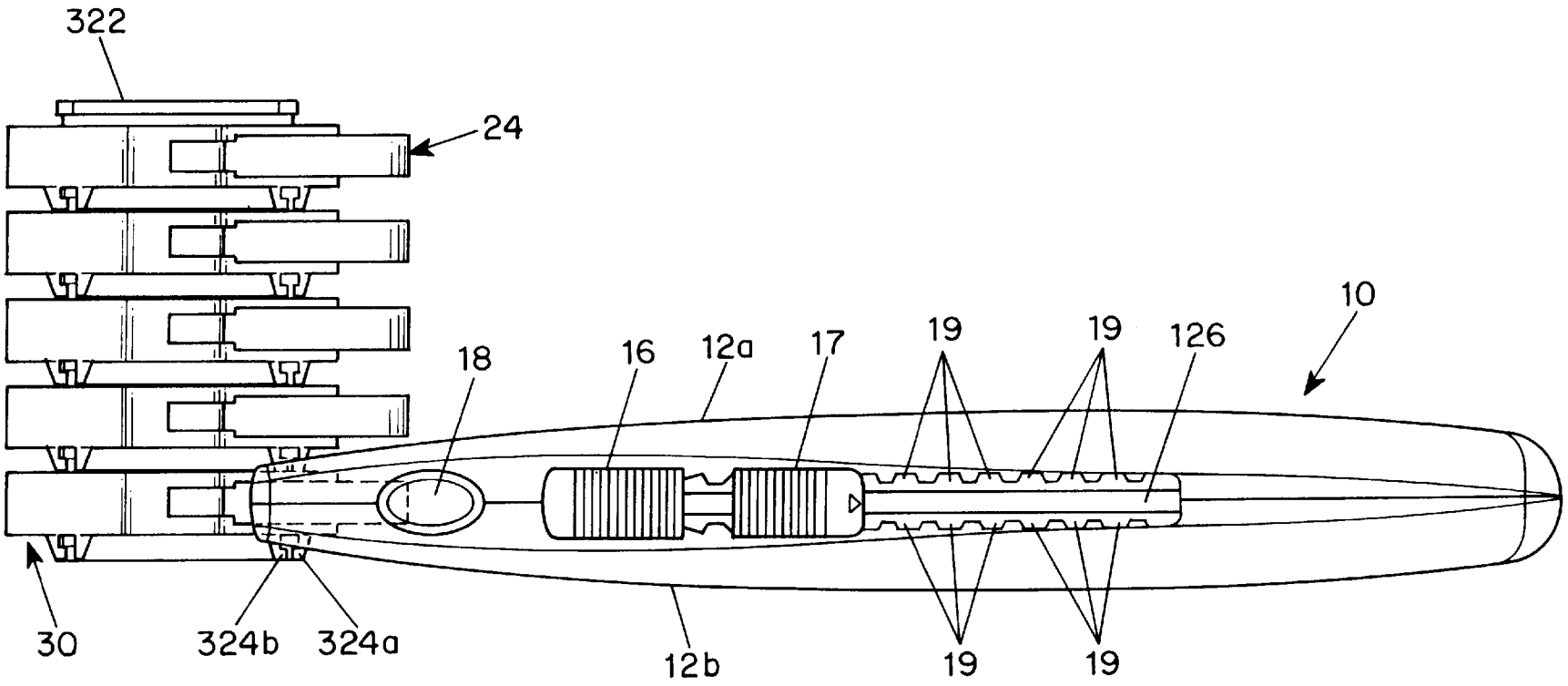
FIG. 6 is a top view of a utility knife system according to a preferred embodiment of the present invention with a plurality of protective blade covers interconnected with each other.

The elongated housing 12 contains a blade opening 122 at one end. In addition, along its top edge, the elongated housing 12 includes a button opening 124 and a slot opening 126. The button opening 124 accommodates the blade release button 18, and the slot opening 126 is a lengthwise slot in which the tab 16 and lock 17 slide back and forth. Preferably, the slot opening 126 contains a series of notches 19 along its sides (as best shown in FIG. 6).

Figure 9A:
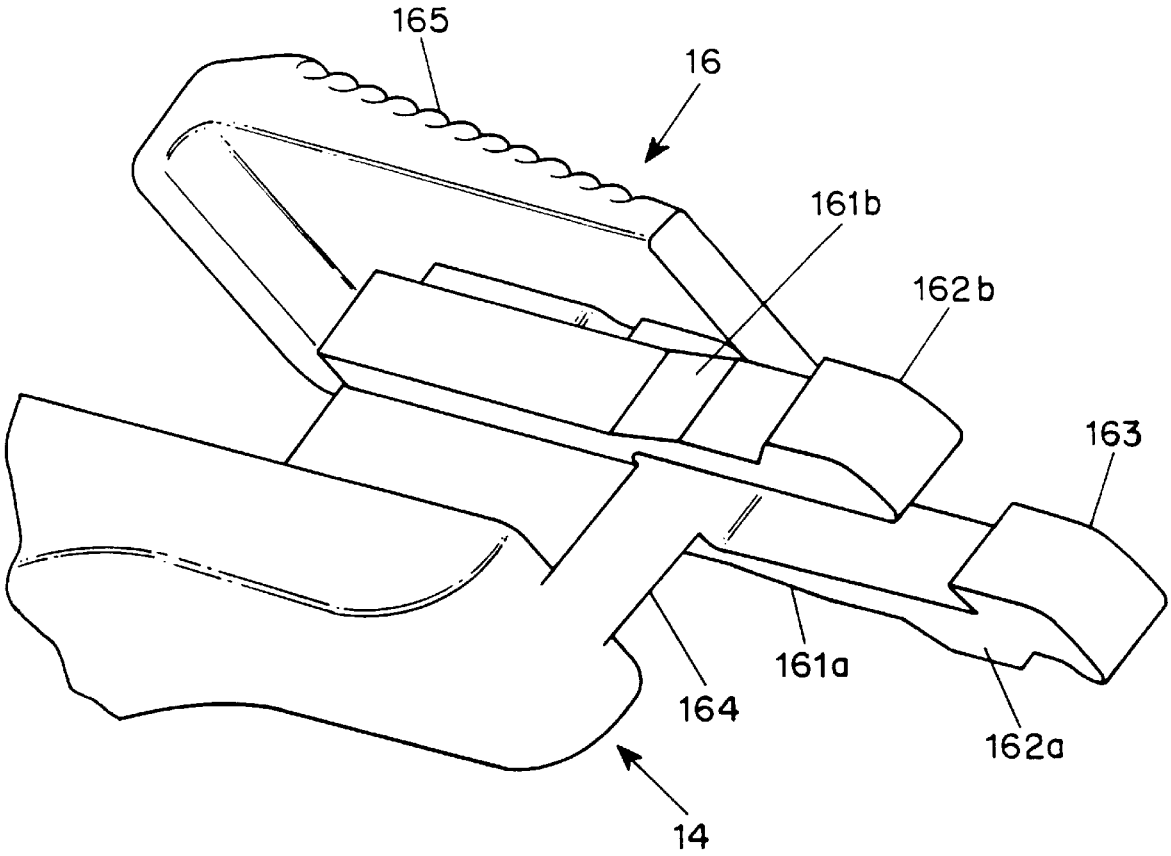
FIG. 9A is a three-dimensional perspective view of a tab of a utility knife system according to a preferred embodiment of the present invention.

The tab 16 is attached, through the slot opening 126, to the guide 14 and is integral therewith. Alternatively, the tab 16 may be fixedly attached to the guide 14 using any suitable attachment means. As shown in FIG. 9A, the tab 16 preferably comprises an upper base 165, which is attached to the guide 14 through a column 164. Between the base 165 and the guide 14, two parallel prongs 161*a* and 161*b* extend rearwardly from the column 164. The prongs 161*a* and 161*b* are resiliently yieldable with respect to each other.

Figure 9B:
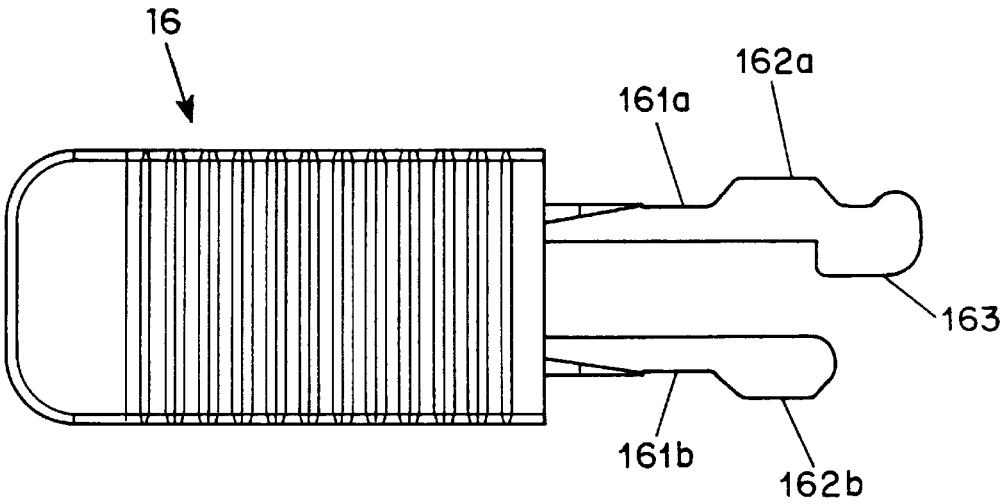
FIG. 9B is a top view of a tab of a utility knife system according to a preferred embodiment of the present invention.

As shown in FIGS. 9A and 9B, the prongs 161*a* and 161*b* have outwardly bulging portions 162*a* and 162*b*, respectively, near their ends. In addition, prong 161*a* has an inwardly bulging portion 163 at its end. The outwardly bulging portions 162*a* and 162*b* fit within the notches 19 along the sides of slot 126.

Figure 10A:
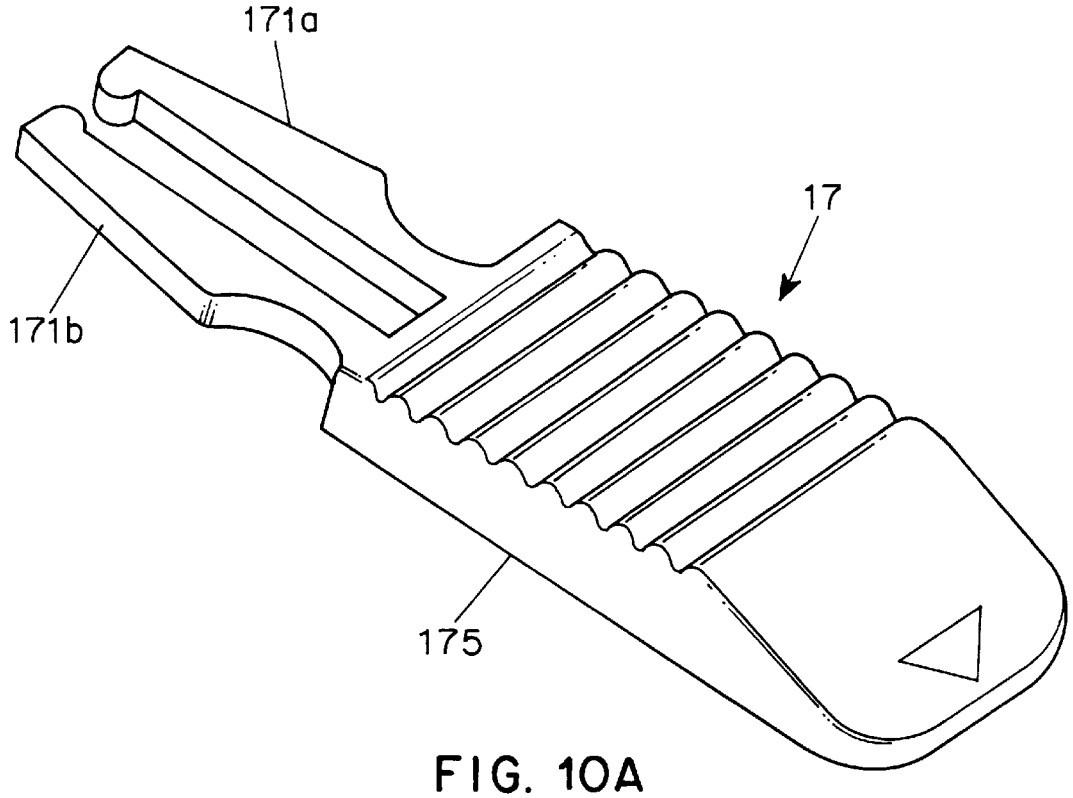
FIG. 10A is a three-dimensional, top perspective view of a lock of a utility knife system according to a preferred embodiment of the present invention.
Figure 10B:
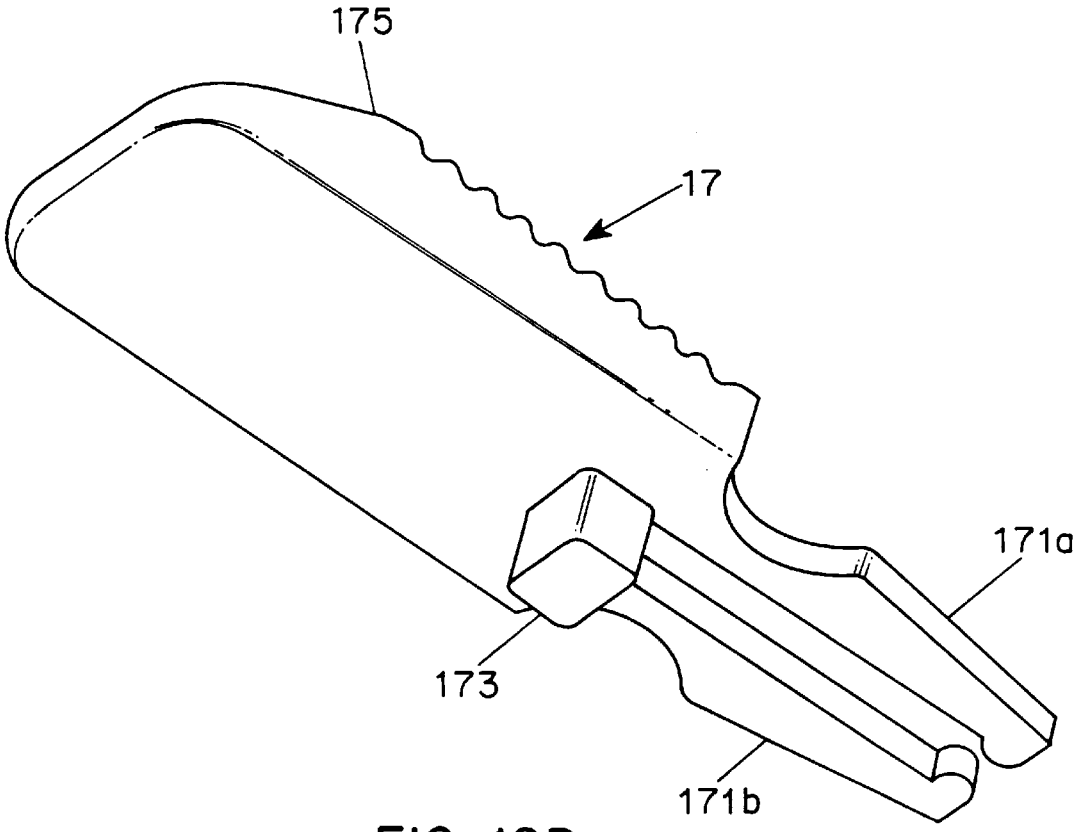
FIG. 10B is a three-dimensional, bottom perspective view of a lock of a utility knife system according to a preferred embodiment of the present invention.

As shown in FIGS. 10A and 10B, the lock 17 comprises a base 175 having two forwardly extending prongs 171*a* and 171*b*. A post 173 is attached underneath and at the forward end of the base 175. The width of the post 173 is approximately the space between the prongs 161*a* and 161*b*.

Figure 11A:
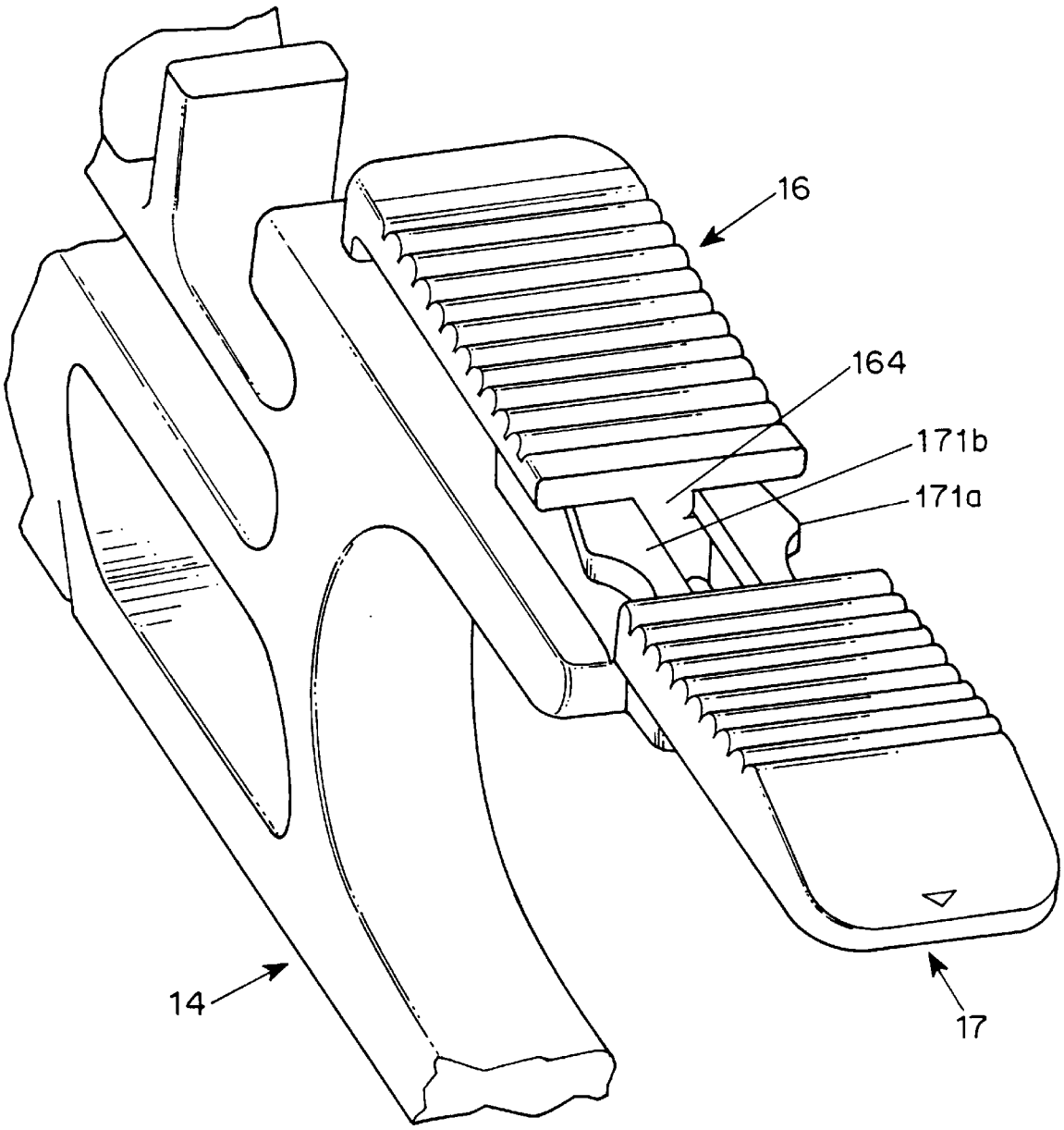
FIG. 11A is a three-dimensional, top perspective view of a tab, lock, and guide of a utility knife system according to a preferred embodiment of the present invention.
Figure 11B:
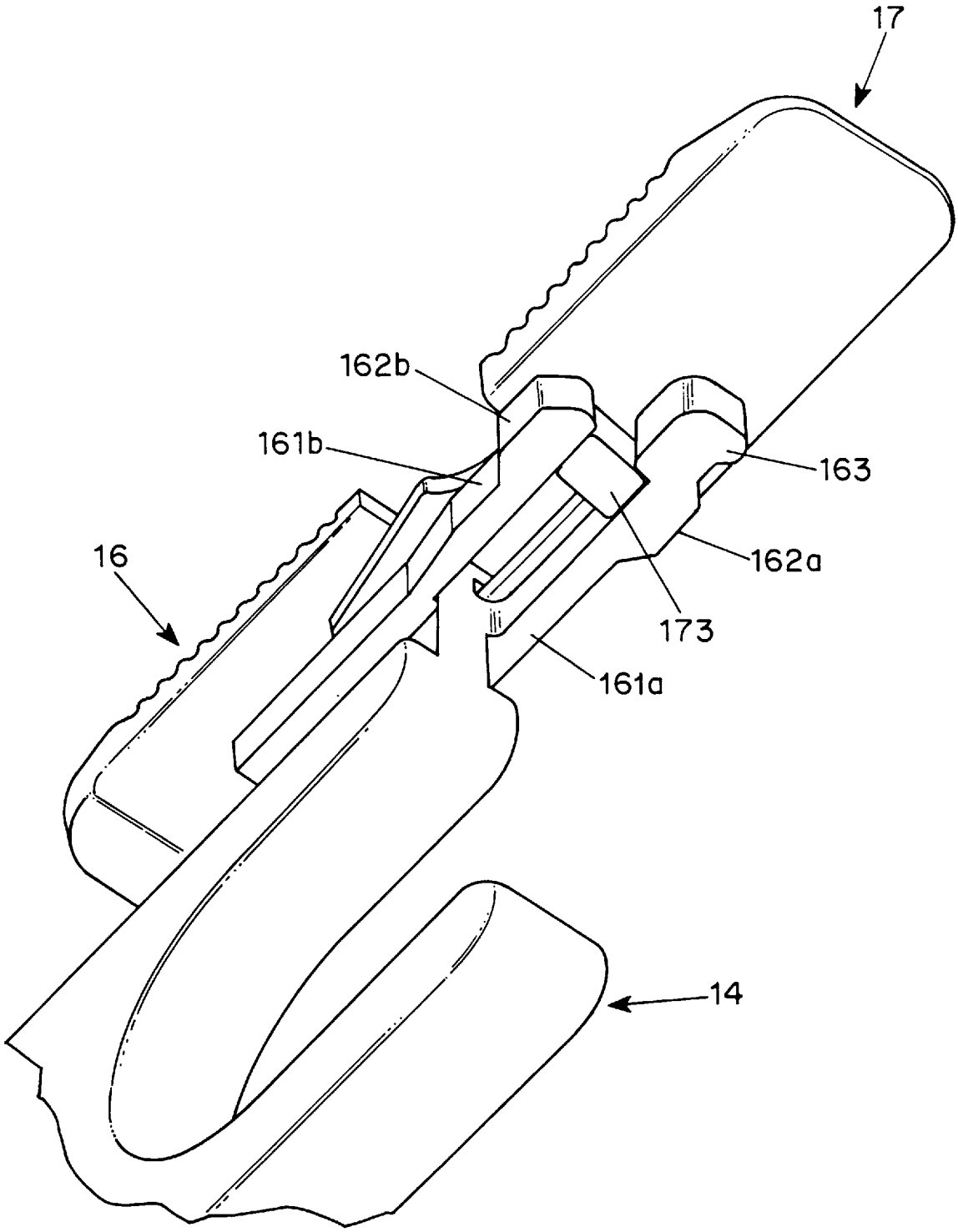
FIG. 11B is a three-dimensional, bottom perspective view of a tab, lock, and guide of a utility knife system according to a preferred embodiment of the present invention.

FIGS. 11A and 11B show the engagement of the tab 16 with the lock 17. The lock prongs 171*a* and 171*b* slide between the tab base 165 and the tab prongs 161*a* and 161*b*. The post 173 is inserted between the tab prongs 161*a* and 161*b*. In this arrangement, the lock 17 is capable of a limited sliding movement with respect to the tab 16. At the lock's forward-most position, the lock base 175 abuts the tab base 165. At the lock's rear-most position, as shown in FIG. 11B, the lock post 173 abuts the tab's inwardly bulging portion 163.

In operation, when the lock 17 is in its forward-most position, the lock post 173 abuts the column 164 and does not block the outwardly bulging portions 162*a* and 162*b* from yielding inwardly, as a result of passing over the ridges formed by the notches 19, when the tab 16 is moved in the slot opening 126. Thus, when the lock 17 is in its forward-most position, the tab 16 is unlocked and is capable of movement within the slot opening 126.

In contrast, when the lock 17 is in its rear-most position, the lock post 173 is positioned in between the outwardly bulging portions 162*a* and 162*b*. In this position, the lock post 173 prevents the outwardly bulging portions 162*a* and 162*b* from yielding inwardly. Thus, the bulging portions cannot pass over the ridges formed by the notches 19, and the tab 16 is locked and cannot move within the slot opening 126.

The guide 14 consists of two portions, a base lower portion 142 and an upper portion 146. The upper portion 146 is resiliently yieldable with respect to the lower portion 142. On the side facing the blade opening 122, the lower portion 142 contains a horizontally projecting member 144 and the upper portion 146 contains an upwardly pointing hook 148. The upper portion 146 also contains a vertical post 149 near its center. When the tab, and correspondingly, the guide are moved to their forward-most position (defined by the side on which the blade opening 122 is located), the vertical post 149 sits beneath the blade release button 18. In this position, the blade release button may be operated to depress the resiliently yieldable upper portion 146.

Preferably, the guide 14, the tab 16, and the lock 17 are made by the injection molding of a plastic material, such as glass-fiber-coupled polypropylene sold by Hoechst UK, Ltd., Wolton, UK, under the trade name HOSTACOM. Preferably, the blade release button 18 is made by the injection molding of a plastic material, such as polypropylene sold by BASF, UK, Cheadle, UK, under the trade name NOVALIN.

Figure 12A:
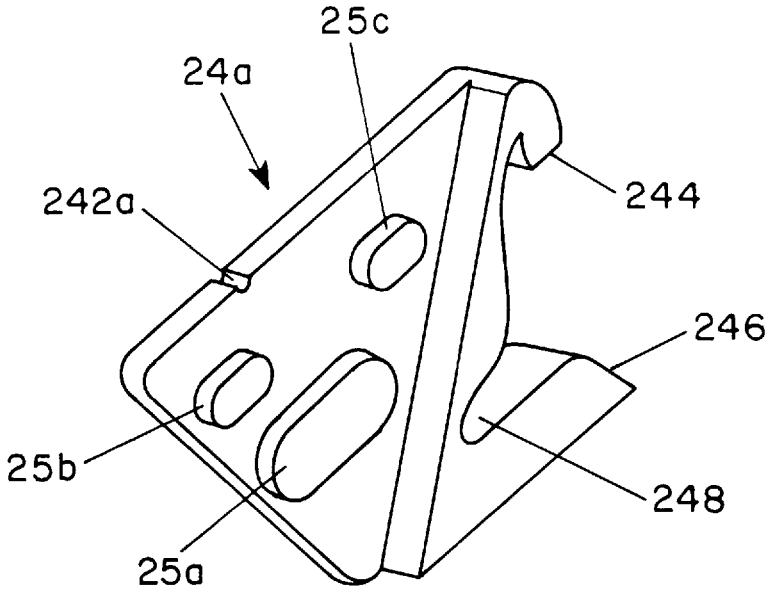
FIG. 12A is a three-dimensional perspective view of a first endpiece half of a utility knife system according to a preferred embodiment of the present invention.
Figure 12B:
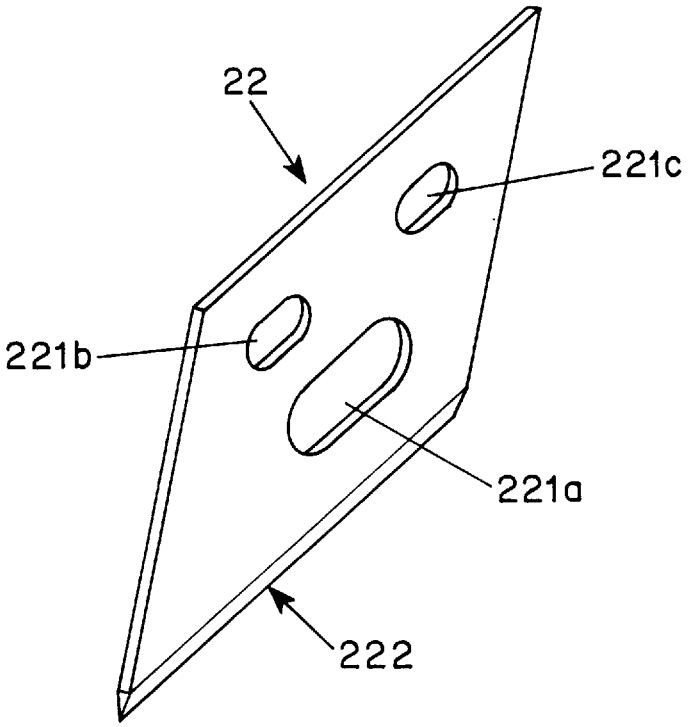
FIG. 12B is a three-dimensional perspective view of a blade of a utility knife system according to a preferred embodiment of the present invention.
Figure 12C:
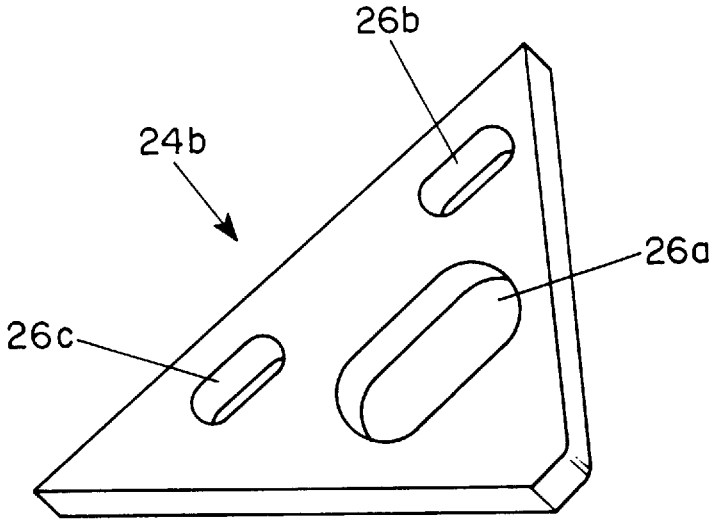
FIG. 12C is a three-dimensional perspective view of a second endpiece half of a utility knife system according to a preferred embodiment of the present invention.

Referring to FIGS. 2, 12A, 12B, and 12C, the blade assembly 20 comprises a blade 22 and an endpiece 24. The blade 22 may be any standard stainless steel or carbon steel blade. As shown in FIG. 12B, the blade 22 has three holes, 221*a*, 221*b*, and 221*c*, for attachment of the blade 22 to the endpiece 24. Again referring to FIGS. 12A and 12C the endpiece 24 preferably comprises two pieces, an endpiece base 24*a* and an endpiece cover 24*b*. The endpiece base 24*a* contains three projections 25*a*, 25*b*, and 25*c*, which fit through the blade holes 221*a*, 221*b*, and 221*c*, respectively. The endpiece cover 24*b* contains three recesses 26*a*, 26*b*, and 26*c*, which receive the projections 25*a*, 25*b*, and 25*c*. As shown, the configuration of the endpiece 24 is such that, when the endpiece 24 is permanently attached to the blade, the cutting edge 222 of the blade is left exposed.

Preferably, the endpiece 24 is made by the injection molding of a plastic material, such as polycarbonate sold by GE Plastics, Pittsfield, Mass., USA, under the trade name LEXAN. The attachment of the endpiece 24 to the blade may be accomplished by, for example, radio frequency induction heating, ultrasonic welding, or integral rivets.

As shown in FIG. 2, the upper and lower surfaces of the endpiece contain two indentations, 242*a* and 242*b*, respectively. In the preferred embodiment shown in FIG. 2, the indentations are grooves that run transverse to the cutting edge 222 of the blade.

The rear of the endpiece 24 contains a horizontally projecting lower member 246 and a downwardly pointing hook 244. The area where the horizontally projecting lower member 246 joins the endpiece 24 defines a recessed area 248. The hook 244 of the endpiece is complementary to the hook 148 of the handle assembly guide.

Referring still to FIG. 2, the protective blade cover 30 is a hollow structure defined by two sets of parallel walls and an end wall 38 (shown in FIG. 1) connecting the parallel walls. The two sets of parallel walls consist of a set of side walls, 32*a* and 32*b*, and a top wall 34 and bottom wall 36 (shown in FIG. 1). The walls are dimensioned to fit over the blade assembly 20 securely and to cover completely the cutting edge 222 of the blade when the blade assembly 20 is inserted into the protective blade cover 30. At the same time, the walls are dimensioned to leave exposed the hook 244 and the horizontally projecting member 246 when the blade assembly 20 is inserted into the protective blade cover 30. Preferably, the protective blade cover 30 is made by the injection molding of a plastic material, such as polystyrene sold by BASF UK, Cheadle, UK, under the trade name POLYSTYROL.

Figure 3:
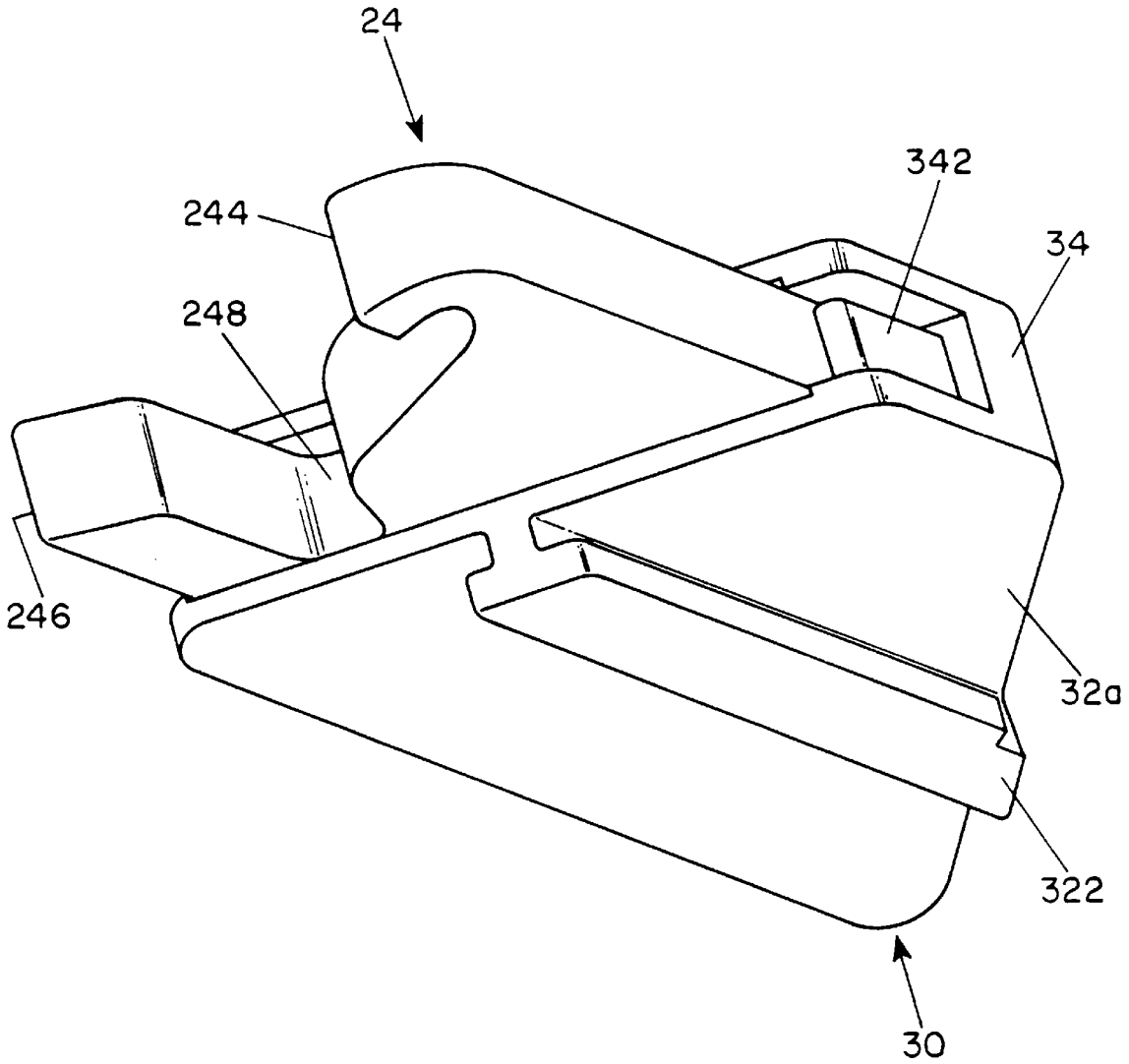
FIGS. 3 and 4 are three-dimensional perspective views of a blade assembly and a protective blade cover, both according to a preferred embodiment of the present invention, which are engaged with each other.
Figure 4:
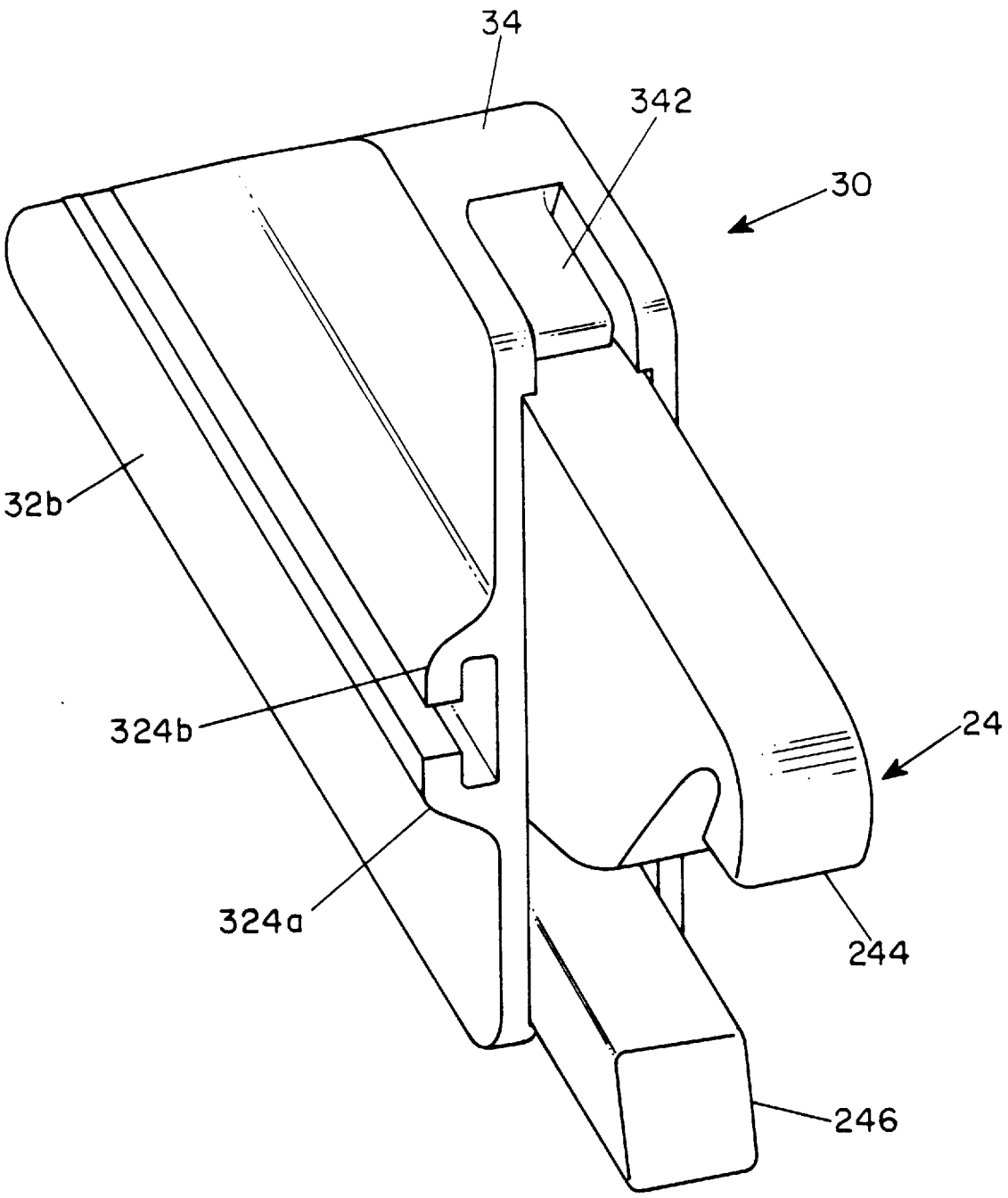

The top wall 34 and the bottom wall 36 (shown in FIG. 1) contain two resiliently yieldable members 342 and 362, respectively, As shown in FIGS. 1 and 2, these members may be, for example, two thin planks of plastic that are joined to the top and bottom walls at one end only. The resiliently yieldable members 342 and 362 have protrusions 344 and 364, respectively (as shown in FIG. 1). The protrusion 344 on member 342 extends downward toward the bottom wall 36, and the protrusion 364 on member 362 extends upward toward the top wall 34. The protrusions 344 and 364 are complementary to the grooves 242*a* and 242*b*, respectively. Therefore, when the blade assembly 20 is inserted into the protective blade cover 30, the protrusions 344 and 364 will snap into the grooves 242*a* and 242*b*. The engagement of the blade assembly 20 and the protective blade cover 30 is shown in FIGS. 3 and 4.

Figure 5:
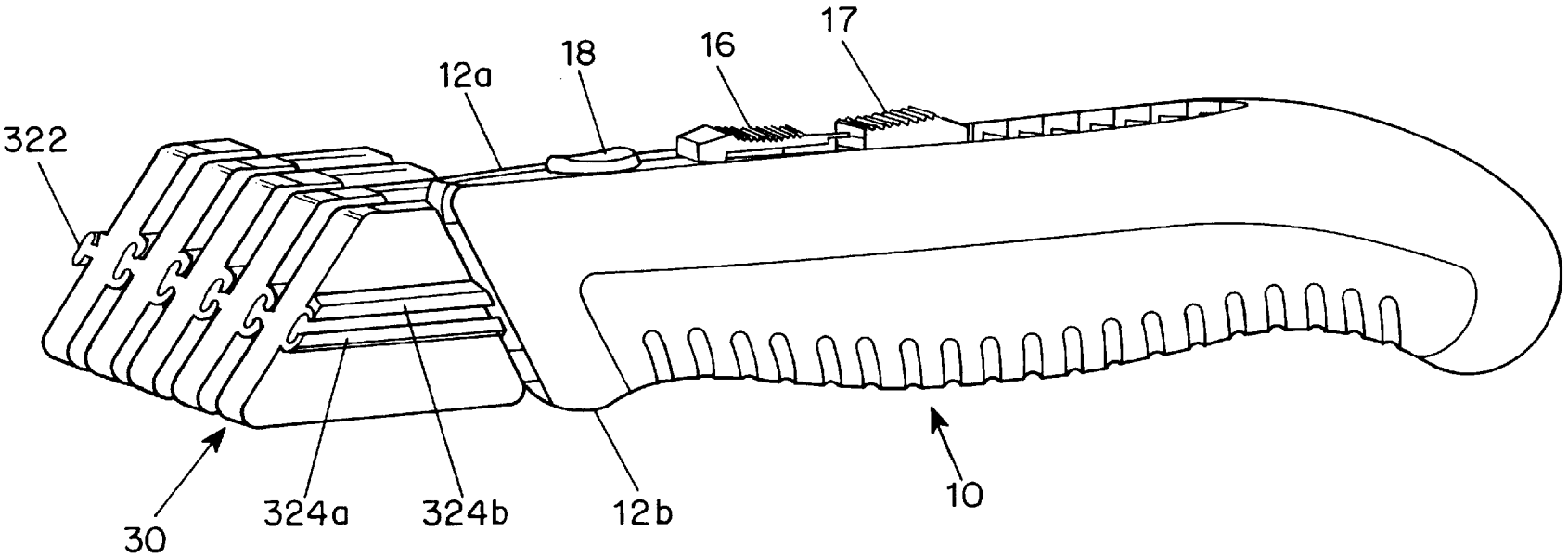
FIG. 5 is a three-dimensional perspective view of a utility knife system according to a preferred embodiment of the present invention with a plurality of protective blade covers interconnected with each other.

Preferably, the side walls 32*a* and 32*b* contain interlocking connectors on them. In a preferred embodiment, the side wall 32*a* contains an elongated projection 322 that is shaped like a "T" in cross-section. The side wall 32*b* contains elongated projections 324*a* and 324*b*. Together, projections 324*a* and 324*b* define a slot into which projection 322 may slide. As shown in FIG. 5, these projections permit any number of protective blade covers to be interconnected together.

Figure 13:
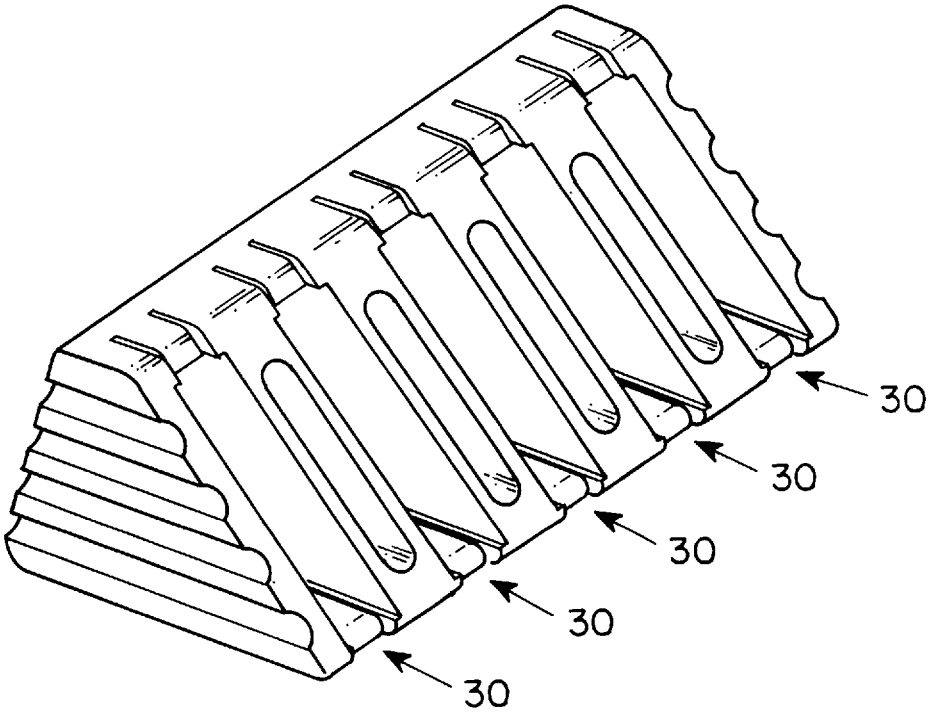
FIG. 13 is a three-dimensional perspective view of a plurality of protective covers integrally formed in a side-by-side relationship according to a preferred embodiment of the present invention.

Alternatively, as shown in FIG. 13, a plurality of protective blade covers 30 may be integrally formed in a side-by-side relationship to form an integral five-piece dispenser for blade assemblies.

In use, the blade assemblies are preferably sold by the manufacturer pre-stored in protective blade covers. To load a pre-stored blade assembly 20 into a handle assembly 10, a user first moves the tab 16 of the handle to its forward-most position. (The guide 14 will correspondingly be moved to its forward-most position as well.) The user then inserts the endpiece 24 of the blade assembly into the blade opening 122 until the downwardly pointing hook 244 of the endpiece makes contact with the upwardly pointing hook 148 of the guide. Applying forward pressure to the tab 16, the user continues to push the blade assembly into the opening 122. Since the hook 148 is mounted on the resiliently yieldable upper portion 146 of the guide, the hook 148 and the upper portion 146 will be depressed downward by the camming action of the downwardly pointing hook 244. When the blade assembly is inserted far enough into the opening 122, the upwardly pointing hook 148 will spring back up and under the downwardly pointing hook 244, thereby engaging the endpiece. For improved stability of operation of the utility knife, the horizontally projecting member 144 of the lower guide portion 146 is designed to fit into the recessed area 248 of the endpiece.

To remove the protective blade cover 30 after the endpiece 24 and the guide 14 have been engaged, the user simply moves the tab 16 backward (away from the opening 122). Since the outer dimensions of the protective blade cover 30 are larger than the opening 122, the user will reach a position where the protective blade 30 cover abuts the end of the handle. At that point, further backward movement of the tab 16 will force the protrusions 344 and 364 to disengage from the grooves 242*a* and 242*b*, respectively.

To change a blade, the user simply moves the tab 16 to its forward-most position, allowing the blade to protrude from the handle. The user than inserts a protective blade cover 30 over the blade until the protrusions 342 and 362 engage the grooves 242*a* and 242*b* of the endpiece. The user then presses the blade release button 18 to depress, via the post 149, the resiliently yieldable upper portion 146 of the guide, thereby unhooking the two hooks 148 and 244. The blade assembly 20, in its protective blade cover 30, is then removed from the handle.

As can be readily seen, the present invention allows a simple and quick exchange of blades without opening up the handle. Moreover, as a result of the cooperation between the protective blade cover 30, the blade assembly 20, and the handle 10, the cutting edges of the blades are covered at all times during the change of the blades. Thus, the present invention provides safety to the user during the exchange of blades.

Although the present invention has been described with reference to a certain preferred embodiment, various modifications, alterations, and substitutions will be known or obvious to those skilled in the art without departing from the spirit and scope of the invention, as defined by the appended claims.

I claim:

1. A utility knife system comprising:

(a) a handle assembly comprising an elongated housing having an internal chamber, a blade opening at an end of the housing for receiving a blade, and a slot disposed parallel to the longitudinal axis of the housing for access to the internal chamber;

a guide within the housing slidable along the longitudinal axis of the housing and having a first latching mechanism disposed thereon; and a tab attached to the guide and extending out of the slot in the housing for controlling the movement of the guide;

(b) a blade assembly comprising a blade having a cutting edge and two ends disposed on opposite sides of the cutting edge; and an endpiece attached to one of the two ends of the blade, the endpiece having a second latching mechanism and a third latching mechanism, the second latching mechanism being complementary to the first latching mechanism of the handle assembly guide, and the second latching mechanism being engageable with the first latching mechanism upon insertion of the second latching mechanism into the blade opening of the handle assembly housing; and (c) a protective blade cover comprising an enclosed hollow structure with an opening for receiving the blade assembly, the hollow structure having inner dimensions such that the protective blade cover fits securely over the blade assembly, outer dimensions such that the protective blade cover completely covers the cutting edge of the blade assembly while leaving exposed the second latching mechanism of the endpiece, and a fourth latching mechanism complementary to the third latching mechanism of the endpiece, the third and fourth latching mechanisms being engageable with each other when the protective blade cover is inserted over the blade assembly.

2. The utility knife system of claim 1, wherein the handle assembly further comprises a blade release button coupled to the handle assembly guide for enabling the disengagement of the first latching mechanism of the guide from the second latching mechanism of the blade assembly endpiece.

3. The utility knife system of claim 1, wherein the slot in the handle assembly housing comprises a plurality of notches along its sides, wherein the tab comprises two resiliently yieldable prongs parallel to the longitudinal axis of the slot, each prong having a bulge portion that is engageable with one of the notches, and wherein the handle assembly further comprises a lock arranged in a slidable relationship with the tab, the lock having a post that slides between the bulge portions of the tab prongs and prevents the bulge portions from yielding inwardly towards each other.

4. The utility knife system of claim 1, wherein the handle assembly guide includes a first portion and a second portion, the first portion being resiliently yieldable with respect to the second portion, wherein the first latching mechanism comprises a hook on the first portion facing the blade opening of the handle assembly housing, and wherein the second latching mechanism of the blade assembly endpiece comprises a hook complementary to the hook on the first portion of the handle assembly guide.

5. The utility knife system of claim 1, wherein the third latching mechanism of the blade assembly endpiece comprises an indentation in an outer surface of the endpiece and the fourth latching mechanism of the protective blade cover comprises a protrusion complementary to the indentation of the endpiece, the protrusion being mounted on a resiliently yieldable member of the protective blade cover; whereby, the protrusion biasingly engages the indentation when the protective blade cover is inserted over the blade assembly.

6. The utility knife system of claim 1, wherein the outer dimensions of the protective blade cover are larger than the dimensions of the blade opening in the handle assembly housing.

7. The utility knife system of claim 1, wherein the protective blade cover further comprises a first side wall and a second side wall parallel to each other, an outer surface of the first side wall including an elongated projection having a substantially constant cross-section throughout its length, and an outer surface of the second side wall including one or more projections forming a slot for slidably receiving an element having the same shape as the projection on the first side wall.

8. A utility knife system comprising:

(a) a handle assembly comprising an elongated housing having an internal chamber, a blade opening at an end of the housing for receiving a blade, and a slot disposed parallel to the longitudinal axis of the housing for access to the internal chamber;

a guide within the housing slidable along the longitudinal axis of the housing and having a first portion and a second portion, the first portion being resiliently yieldable with respect to the second portion and having a hook facing the blade opening of the handle assembly housing; and a tab attached to the guide and extending out of the slot in the housing for controlling the movement of the guide; and (b) a blade assembly comprising a blade having a cutting edge and two ends disposed on opposite sides of the cutting edge; and an endpiece attached to one of the two ends of the blade having a hook complementary to the hook of the first portion of the handle assembly guide.

9. A utility knife system comprising:

(a) a blade assembly comprising a blade having a cutting edge and two ends disposed on opposite sides of the cutting edge; and an endpiece attached to one of the two ends of the blade having an indentation disposed on the outer surface thereof; and (b) a protective blade cover comprising an enclosed hollow structure with an opening for receiving the blade assembly, the hollow structure having inner dimensions such that the protective blade cover fits securely over the blade assembly, outer dimensions such that the protective blade cover completely covers the cutting edge of the blade, and a resiliently yieldable member disposed thereon having a protrusion complementary to the indentation of the endpiece.

* * * * *